US007020428B2

(12) United States Patent
Park et al.

(10) Patent No.: US 7,020,428 B2
(45) Date of Patent: Mar. 28, 2006

(54) WASTE TONER COLLECTING DEVICE OF AN ELECTROPHOTOGRAPHIC IMAGE FORMING APPARATUS, METHOD THEREOF, AND AN ELECTROPHOTOGRAPHIC PRINTER HAVING THE SAME

(75) Inventors: Moon-bae Park, Gyeonggi-do (KR); Heung-sup Jeong, Gyeonggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 85 days.

(21) Appl. No.: 10/734,608

(22) Filed: Dec. 15, 2003

(65) Prior Publication Data

US 2004/0161272 A1 Aug. 19, 2004

(30) Foreign Application Priority Data

Dec. 27, 2002 (KR) ..... 10-2002-0085443

(51) Int. Cl.
*G03G 21/12* (2006.01)
*G03G 21/00* (2006.01)

(52) U.S. Cl. ..... 399/360; 399/358

(58) Field of Classification Search ..... 399/98, 399/102, 123, 358, 360
See application file for complete search history.

(56) References Cited

U.S. PATENT DOCUMENTS 4,313,674 A * 2/1982 Ura et al. ..... 399/360
4,841,333 A * 6/1989 Damji ..... 399/98 X
4,849,791 A * 7/1989 Hagihara et al. ..... 399/360
4,941,022 A * 7/1990 Ohmura et al. ..... 399/358
5,020,697 A * 6/1991 Koiso et al. ..... 399/358 X
5,132,740 A * 7/1992 Okamoto et al. ..... 399/360
5,581,342 A * 12/1996 Yamauchi ..... 399/123
5,617,195 A * 4/1997 Torimaru et al. ..... 399/123 X
5,634,186 A * 5/1997 Villalobos-Garcia et al. ..... 399/360
5,708,952 A * 1/1998 Taniguchi et al. ..... 399/358
6,014,541 A * 1/2000 Kato et al. ..... 399/358
6,266,511 B1 * 7/2001 Murakami et al. ..... 399/358

FOREIGN PATENT DOCUMENTS

JP 06-012005 * 1/1994
JP 06-242710 * 9/1994

* cited by examiner

*Primary Examiner*—Sandra L. Brase
(74) *Attorney, Agent, or Firm*—Staas & Halsey LLP

(57) ABSTRACT

A waste toner collecting device of an electrophotographic printer is provided. The device includes a housing to temporarily hold waste toner removed from an image holding body, an exhaust guide member including an exhaust hole through which the waste toner is exhausted, an opening and closing unit to open and close the exhaust hole, an inlet guide member having an inlet path to connect the exhaust hole to an inlet of a waste toner collection tank, and an elastic member which elastically supports the inlet guide member so that a gap between the exhaust hole and an inlet side of the inlet path is closely maintained when the exhaust guide member ascends and descends.

18 Claims, 11 Drawing Sheets

WASTE TONER COLLECTING DEVICE OF AN ELECTROPHOTOGRAPHIC IMAGE FORMING APPARATUS, METHOD THEREOF, AND AN ELECTROPHOTOGRAPHIC PRINTER HAVING THE SAME

CROSS-REFERENCE TO RELATED APPLICATIONS

This application claims the benefit of Korean Patent Application No. 2002-85443, filed on Dec. 27, 2002, in the Korean Intellectual Property Office, the disclosure of which is incorporated herein in its entirety by reference.

BACKGROUND OF THE INVENTION

1. Field of the Invention

The present invention is related to a waste toner collecting device, more particularly, to a waste toner collecting device that collects waste toner generated in an electrophotographic image forming apparatus and transfers the collected waste toner to a predetermined location.

2. Description of the Related Art

Generally, a printer or a copier that uses electrophotography, as illustrated in FIG. 1, includes a photosensitive body 30 on which a toner image is formed, a cleaning blade (not shown) which removes waste toner remaining after the toner image is transferred onto paper or to an intermediate transfer body from the photosensitive body 30, and a waste toner collecting device 10 which receives the waste toner removed by the cleaning blade and transfers the received waste toner to a waste toner collection tank 20.

FIG. 2 shows a conventional waste toner collecting device 10. The conventional waste toner collecting device includes a housing 11 in which waste toner separated from a photosensitive body (not shown) is temporarily held, an auger 12 which rotates in the housing 11 and transfers the waste toner collected in the housing 11 to one end of the housing 11, an exhaust guide member 13 installed to an end of the auger 12, which includes an exhaust hole 13*a* through which the waste toner transferred by rotation of the auger 12 is exhausted, a shutter 15 rotatably installed in the exhaust guide member 13 to open the exhaust hole 13*a*, and a torsion spring 14 which provides elastic force in the direction the shutter 15 closes the exhaust hole 13*a*. An interference piece 15*a* of the shutter 15 collides with a jaw 16 installed on a printer frame 17 when the waste toner collecting device descends towards an inlet 21 of the waste toner collection tank 20.

Thus, the waste toner removed from the photosensitive body by a cleaning unit, such as the cleaning blade, drops into the housing 11 and is transferred to the exhaust hole 13*a* of the exhaust guide member 13 by rotation of the auger 12. Accordingly, when the waste toner collecting device 10 descends towards the inlet 21 of the waste toner collection tank 20, the interference piece 15*a* comes in contact with the jaw 16, and the shutter 15 opens as shown in FIG. 3, so that the waste toner is exhausted to the waste toner collection tank 20 through the exhaust hole 13*a*. On the contrary, when the waste toner collecting device 10 ascends away from the inlet 21 as shown in FIG. 4, there is no interference between the interference piece 15*a* and the jaw 16, and the shutter 15 closes due to restoration force generated via the torsion spring 14.

However, according to the conventional waste toner collecting device having the above structure, the exhaust hole 13*a* comes in contact with the inlet 21 of the waste toner collection tank 20 after the shutter 15 has completely been opened. Thus, the waste toner may splatter out before the exhaust hole 13*a* comes in contact with the inlet 21 of the waste toner collection tank 20. For example, when the waste toner collecting device 10 descends and the interference piece 15*a* comes in contact with the jaw 16 and the shutter 15 opens, the waste toner pours out through the exhaust hole 13*a*. However, in this case, the exhaust hole 13*a* is not in complete contact with the inlet 21 of the waste toner collection tank 20 because the exhaust hole 13*a* is spaced by a predetermined gap from the inlet 21 of the waste toner collection tank 20, and thus, the waste toner may splatter through the gap between the exhaust hole 13*a* and the inlet 21 of the waste toner collection tank 20. Similarly, when the waste toner collecting device 10 ascends, a gap between the exhaust hole 13*a* and the waste toner collection tank 20 is formed before the shutter 15 completely closes, and thus, the same problem occurs. Accordingly, when the waste toner splatters out, peripheral devices may be greatly contaminated. Thus, counter measures thereof are needed.

SUMMARY OF THE INVENTION

An aspect of the present invention provides a waste toner collecting device having an improved structure which prevents waste toner from splattering out when the waste toner is transferred to a waste toner collection tank, a method thereof, and an electrophotographic printer having the waste toner collecting device.

According to another aspect of the present invention, a waste toner collecting device of an electrophotographic printer includes a housing to temporarily hold waste toner removed from an image holding body, an exhaust guide member which provides an exhaust hole through which the waste toner is exhausted, an opening and closing unit which opens and closes the exhaust hole, an inlet guide member having an inlet path to connect the exhaust hole to an inlet of a waste toner collection tank, and an elastic member which elastically supports the inlet guide member so that a gap between the exhaust hole and an inlet side of the inlet path is closely maintained when the exhaust guide member ascends and descends.

Additional aspects and advantages of the invention will be set forth in part in the description which follows and, in part, will be obvious from the description, or may be learned by practice of the invention.

According to another aspect of the present invention, an electrophotographic printer is provided that comprises, an image holding body to temporarily hold a toner image when an image is formed, a waste toner collection tank to hold waste toner removed from the image holding body, and a waste toner collecting device to collect the waste toner removed from the image holding body into the waste toner collection tank, where the waste toner collecting device includes a housing to temporarily hold the waste toner, an exhaust guide member having an exhaust hole through which the waste toner is exhausted, an opening and closing unit which opens and closes the exhaust hole, an inlet guide member having an inlet path to connect the exhaust hole to an inlet of a waste toner collection tank, and an elastic member which elastically supports the inlet guide member so that a gap between the exhaust hole and an inlet side of the inlet path is closely maintained when the exhaust guide member ascends and descends.

According to another aspect of the present invention, a method to collect waste toner of an electrophotographic printer is provided. The electrophotographic printer comprises an exhaust guide member including an exhaust hole through which waste toner removed from an image holding body that temporarily holds a toner image is exhausted, an inlet guide member having an inlet path to connect the exhaust hole to an inlet of a waste toner collection tank elastically supported by an elastic member towards the exhaust guide member, and an opening and closing unit which opens and closes the exhaust hole. The method to collect waste toner comprises descending the exhaust guide member when the exhaust hole is closed, closely adhering the exhaust hole and an inlet side of the inlet path to each other, opening the exhaust hole via the opening and closing unit, and closing the exhaust hole when the exhaust guide member ascends via the opening and closing unit before the exhaust hole is spaced apart from the inlet side of the inlet path.

BRIEF DESCRIPTION OF THE DRAWINGS

The above and/or other aspects and advantages of the invention will become apparent, and more readily appreciated from the following description of the preferred embodiment, taken in conjunction with accompanying drawings of which.

DETAILED DESCRIPTION OF THE PREFERRED EMBODIMENTS

Figure 1:
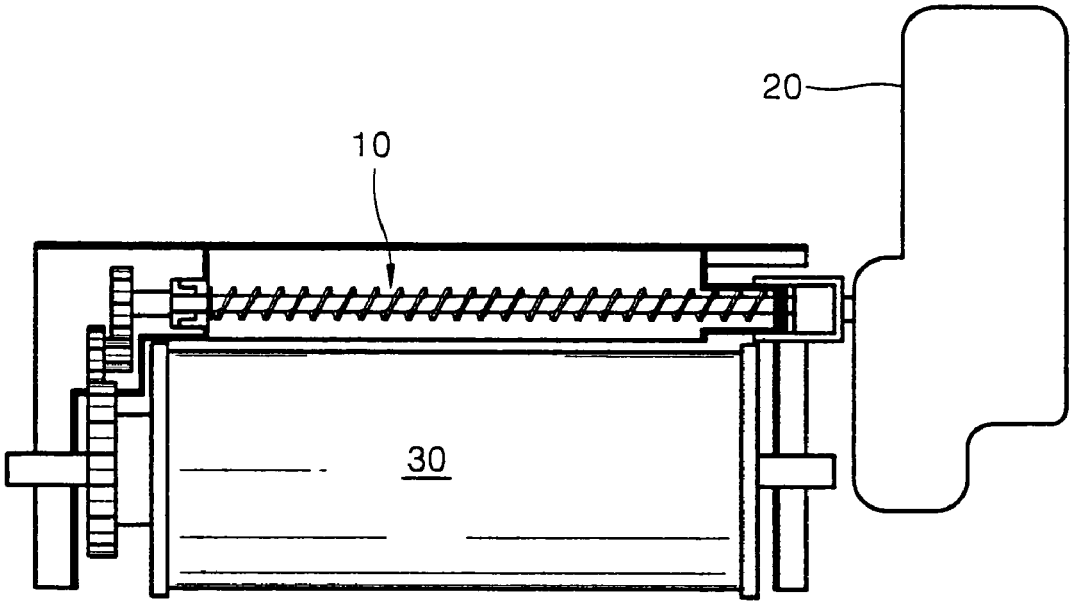
FIG. 1 (PRIOR ART)
FIG. 1 is a plane view schematically showing the structure of a conventional waste toner collecting device of an electrophotographic printer.
Figure 2:
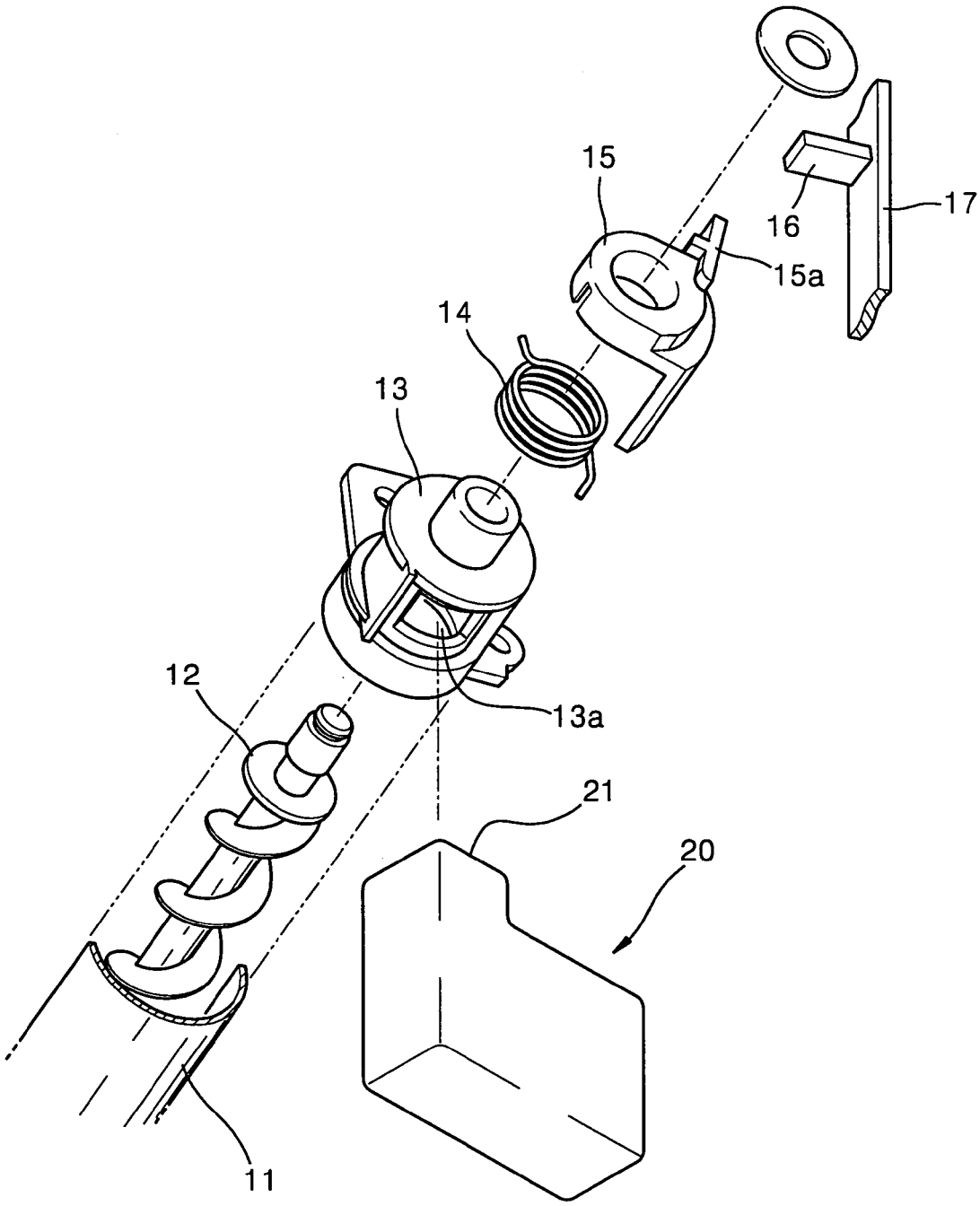
FIG. 2 (PRIOR ART)
FIG. 2 is an exploded perspective view to show an example of a conventional waste toner collecting device.
Figure 3:
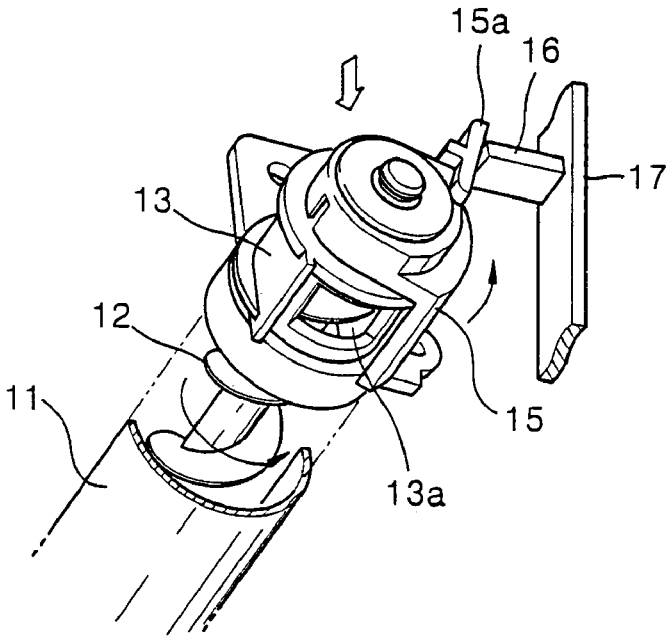
FIG. 3 (PRIOR ART)
FIGS. 3 and 4 show the open and closed states of the conventional waste toner collecting device, respectively.
Figure 4:
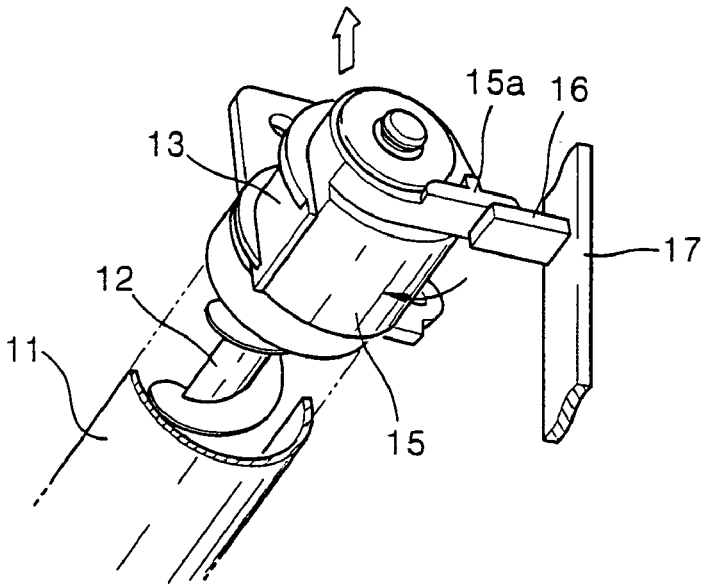
FIG. 4 (PRIOR ART)

Reference will now be made in detail to the embodiments of the present invention, examples of which are illustrated in the accompanying drawings, wherein like reference numerals refer to the like elements throughout.

Figure 5:
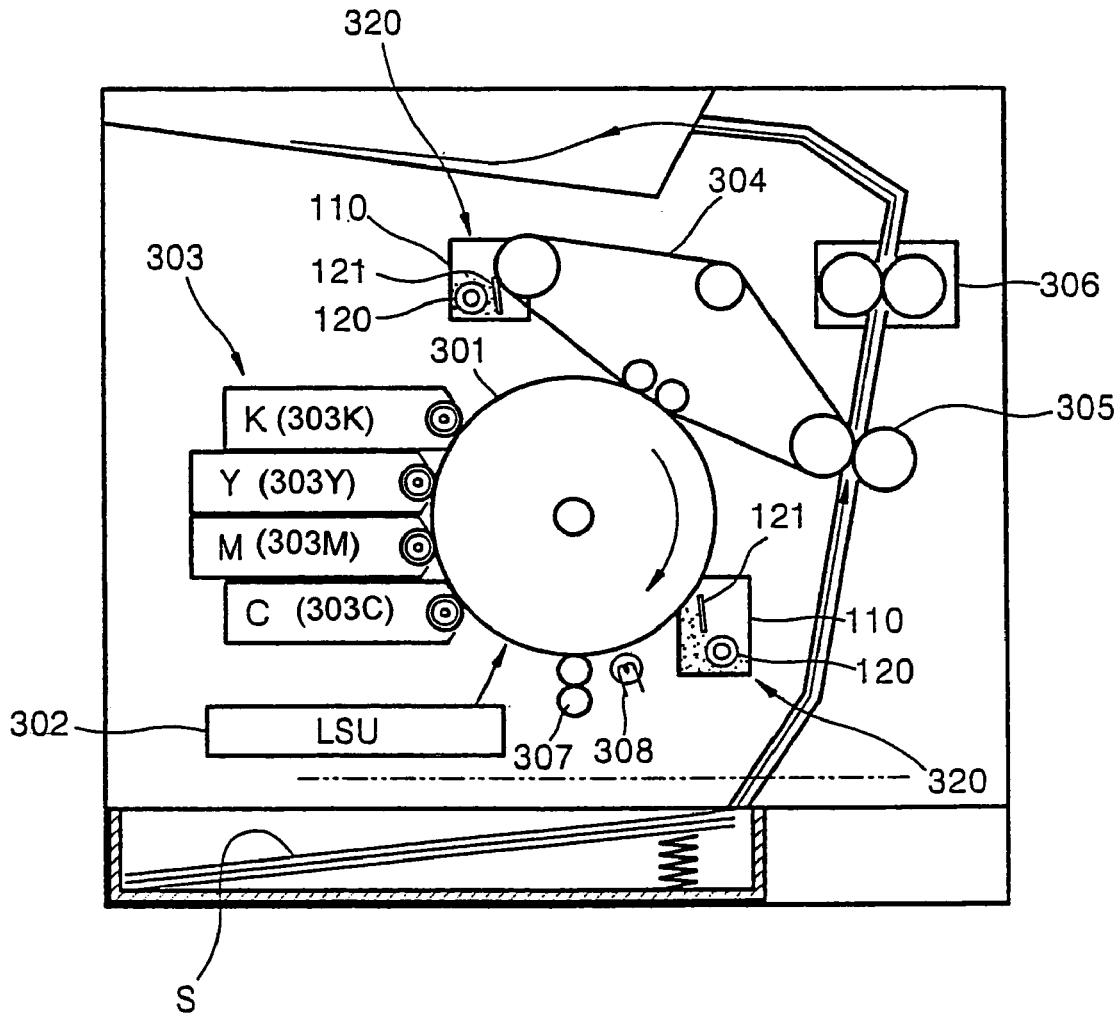
FIGS. 5 and 6 schematically illustrate a structure of an electrophotographic printer according to an embodiment of the present invention.

FIG. 5 schematically illustrates a structure of an electrophotographic printer according to an embodiment of the present invention. As shown in FIG. 5, the electrophotographic printer includes a photosensitive drum 301, an exposure unit 302, a developing unit 303, and a transfer belt 304.

Figure 6:
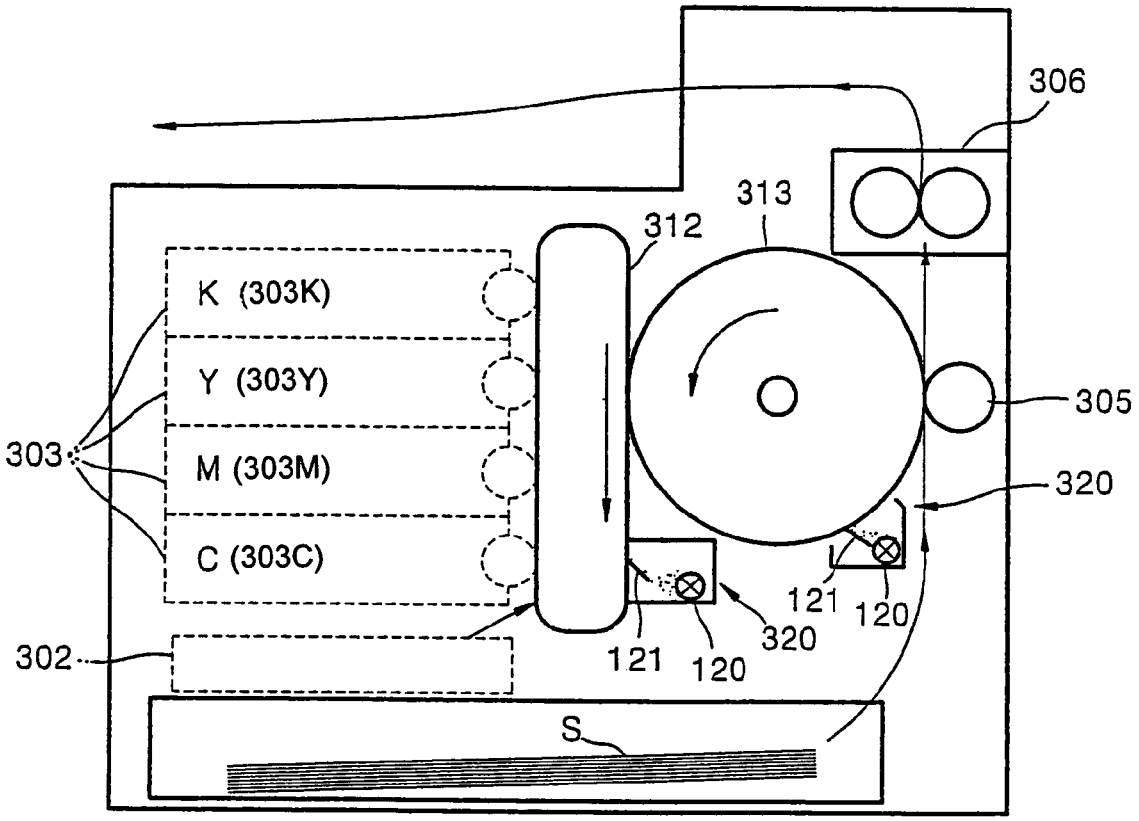

The photosensitive drum 301, illustrated as an example of a photoreceptor, is made by forming a photo conductive material layer on an outer circumference of a metallic drum. A photosensitive belt 312, as shown in FIG. 6, instead of the photosensitive drum 301 in FIG. 5 may also be used.

The exposure unit 302 forms an electrostatic latent image by radiating light corresponding to an image information on the photosensitive drum 301 charged to have a uniform potential by a charger 307. Generally, a Laser Scanning Unit (LSU) using a laser diode as a light source is used as the exposure unit 302.

Four developing units 303C, 303M, 303Y, and 303K hold solid powder state of a toner having four colors, cyan (C), magenta (M), yellow (Y), and black (K), respectively, and form a toner image by supplying toner to the electrostatic latent image formed on the photosensitive drum 301.

The transfer belt 304 is an example of an intermediate transfer medium which receives the toner image from the photoreceptor and transfers the toner image to a recording medium S. However, a transfer drum 313 shown in FIG. 6, instead of the transfer belt 304, may also be used. The toner image having the four colors of cyan (C), magenta (M), yellow (Y), and black (K) that is sequentially formed on the photosensitive drum 301, is sequentially transferred and superimposed on the transfer belt 304 such that a color toner image is formed. A transfer roller 305 is installed opposite the transfer belt 304, and when the recording medium S passes between the transfer belt 304 and the transfer roller 305, the color toner image is transferred onto the recording medium S. When the recording medium S onto which the toner image is transferred passes a fusing unit 306, the toner image is fused on the recording medium S by heat and pressure. Further, an eraser 308 which removes charge remaining on the photosensitive drum 301 after the toner image is transferred onto the transfer belt 304 is provided.

Accordingly, the toner image having the four colors, cyan (C), magenta (M), yellow (Y), and black (K), is superimposed on the transfer belt 304, transferred onto the recording medium S, and fused on the recording medium S by heat and pressure such that the color toner image is formed.

FIG. 6 illustrates a structure of an electrophotographic printer according to another embodiment of the present invention. As shown in FIG. 6, the electrophotographic printer includes a photosensitive belt 312 and a transfer drum 313 located parallel to the photosensitive belt 312.

The photosensitive drum 301 and the transfer belt 304 of FIG. 5 and the photosensitive belt 312 and the transfer drum 313 of FIG. 6 are image holding bodies in which a toner image is temporarily held before the toner image is transferred onto the recording medium S. When the toner image is transferred to the photosensitive drum 301 (or the photosensitive belt 312), the transfer belt 304 (or the transfer drum 313), and the recording medium S, some toner remains on the photosensitive drum 301 (or the photosensitive belt 312) or the transfer belt 304 (or the transfer drum 313). Generally, waste toner remaining on the image holding bodies are removed in order to effectively perform the next printing operation.

A cleaning unit 320, which removes the waste toner from the photosensitive drum 301 is shown in FIG. 5. According to an embodiment of the present invention, the cleaning unit 320 includes a blade 121, which is in contact with the photosensitive drum 301 to scrape off the waste toner. The waste toner removed from the photosensitive drum 301 using the blade 121 is temporarily held in a housing 110. In addition, the cleaning unit 320 having similar structure may be provided to remove the waste toner from the transfer belt 304. Similarly, the electrophotographic printer shown in FIG. 6 may be provided with the waste toner cleaning unit 320 shown in FIG. 5 to remove the waste toner from the photosensitive belt 312 and the transfer drum 313. The waste toner removed from the photoreceptor or the intermediate transfer medium by the cleaning unit 320 is transferred to a waste toner collection tank (200 of FIG. 7) by a waste toner collecting device.

Figure 7:
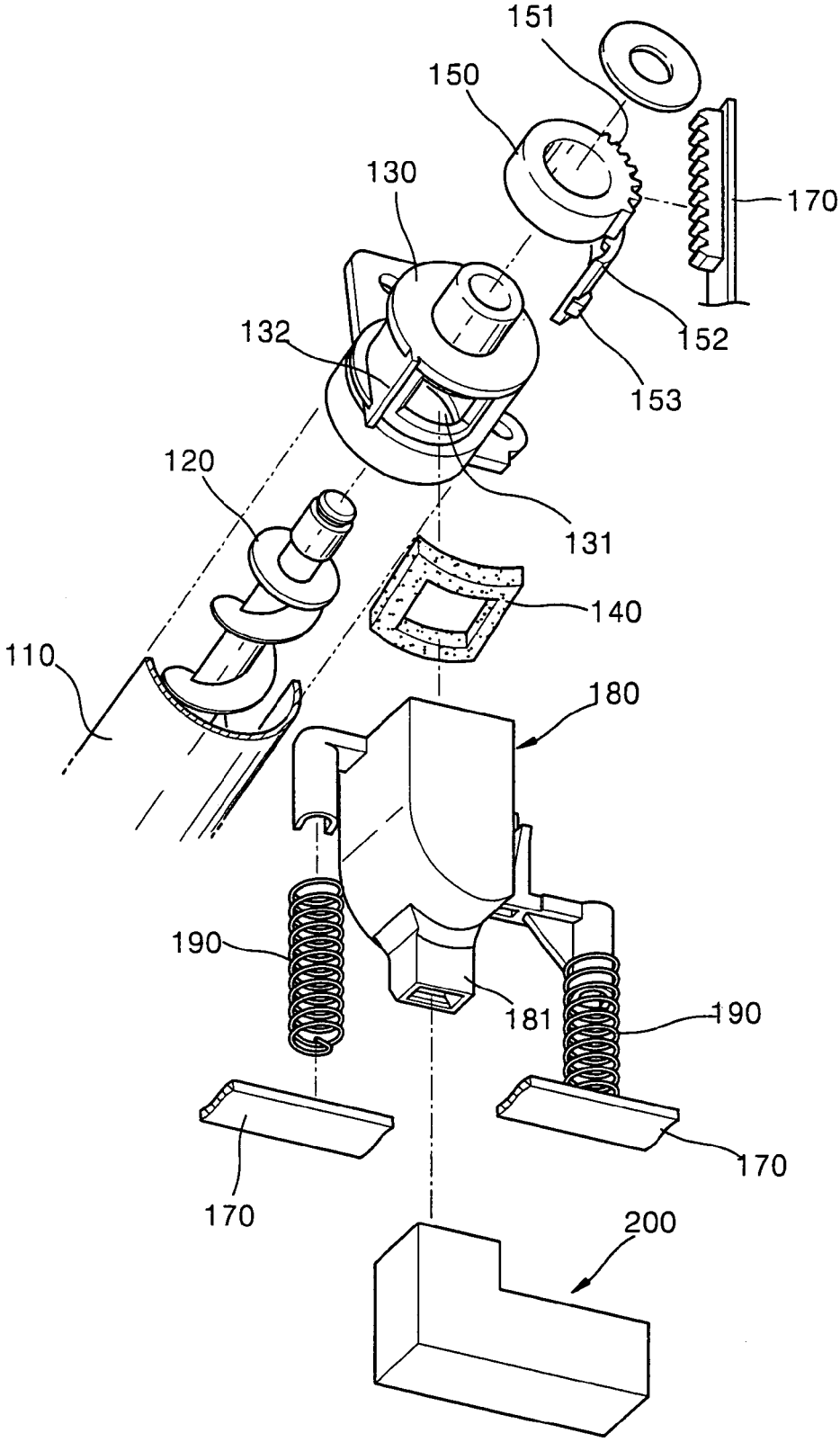
FIG. 7 is an exploded perspective view to show a waste toner collecting device according to an embodiment of the present invention.

FIG. 7 is an exploded perspective view of a waste toner collecting device according to an embodiment of the present invention.

As shown in FIG. 7, according to an embodiment of the present invention, the waste toner collecting device includes a housing 110 to temporarily hold waste toner removed from an image holding body in which a toner image is temporarily formed, an exhaust guide member 130 having an exhaust hole 131 through which the waste toner is exhausted from the housing 110, an opening and closing unit having a shutter 150 to open and close the exhaust hole 131 and an inlet guide member 180 that includes an inlet path 181 to connect the exhaust hole 131 to an inlet of the waste toner collection tank 200. The waste toner collecting device also comprises an auger 120 which transfers the waste toner temporarily held in the housing 110 to the exhaust hole 131.

Generally, an image holding body may be mounted on a printer or removed from the printer. Similarly, the cleaning unit 320 and the housing 110 may be mounted on the printer or removed from the printer together with the image holding body. According to an aspect of the present invention, the exhaust guide member 130 is provided on one end of the housing 110.

Figure 8A:
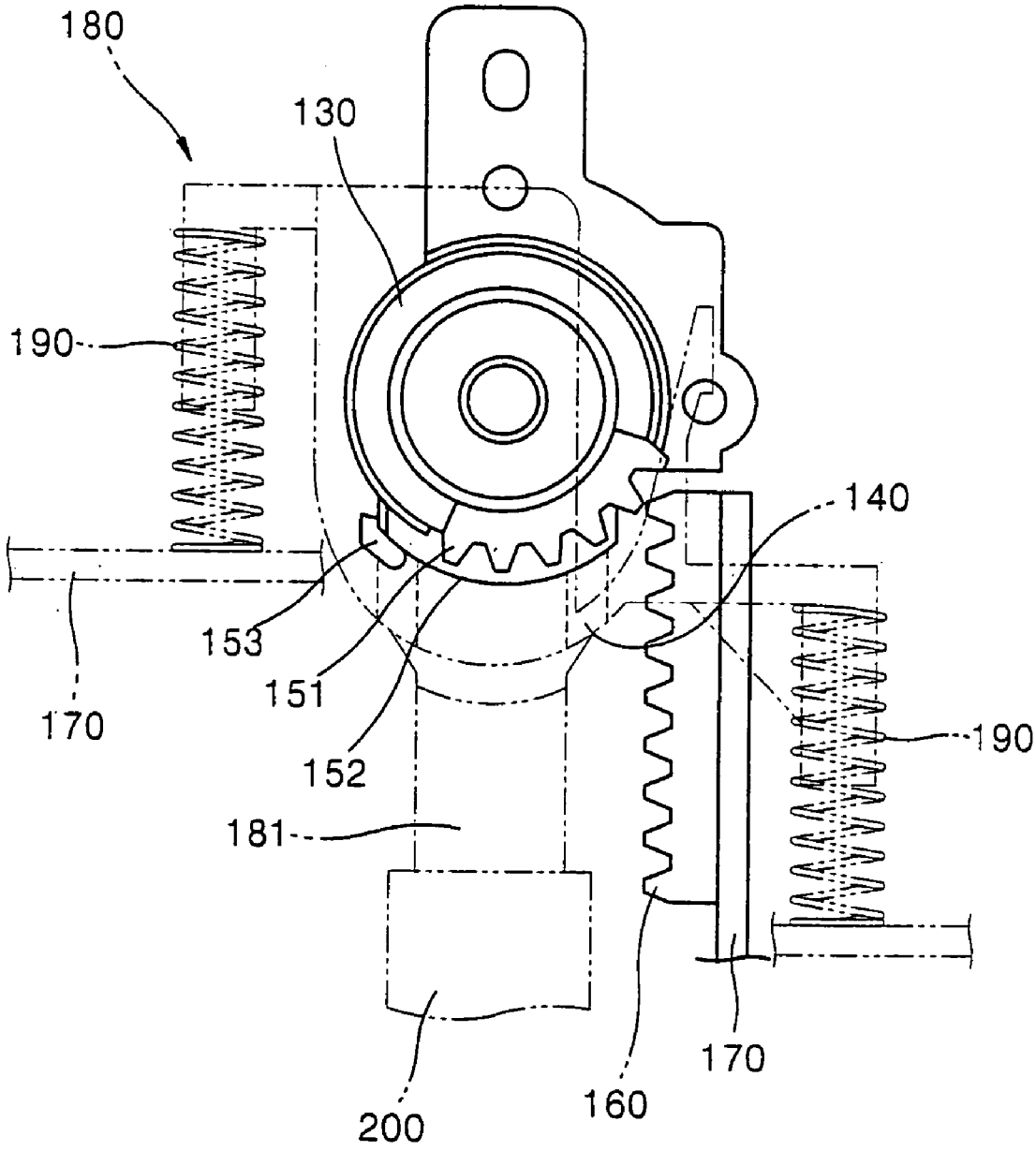
FIGS. 8A and 8B are a front view and a perspective view of the closed state of an exhaust hole of the waste toner collecting device.

The opening and closing unit further includes a rack 160, as shown in FIG. 8A, engaged with a pinion 151 formed on the shutter 150, where the shutter 150 is rotatably installed to the exhaust guide member 130. The rack 160 is fixedly installed to a printer frame 170. When the waste toner collecting device ascends or descends, the pinion 151 is rolled along a gear side of the fixed rack 160 such that the shutter 150 is rotated and a cover portion 152 opens and closes the exhaust hole 131.

According to an embodiment of the present invention, a case where the image holding body ascends and descends in upward and downward directions, and a case where the holding body is removed from the printer will be described.

A compression spring 190, an elastic member, that elastically supports the inlet guide member 180 with respect to the printer frame 170 and closely maintains a gap between the exhaust hole 131 and an inlet side of an inlet path 181 when the exhaust guide member 130 ascends or descends is provided to the waste toner collecting device. When the image holding body is mounted to the printer, the exhaust guide member 130 descends and pushes the inlet guide member 180. Accordingly, when the compression spring 190 is compressed, the inlet guide member 180 descends simultaneously. On the contrary, when the image holding body is removed from the printer, the exhaust guide member 130 ascends, and the inlet guide member 180 also ascends in its original position by a restoration force generated via the compression spring 190. Further, a locking portion 132 is provided in the exhaust guide member 130 to which a locking protrusion 153 of the shutter 150 is elastically inserted.

In addition, a sponge 140 which is an elastic sealing member, is provided to elastically close a gap between the exhaust hole 131 and the inlet path 181. The sponge 140 may be attached to the inlet side of the inlet path 181.

Figure 8B:
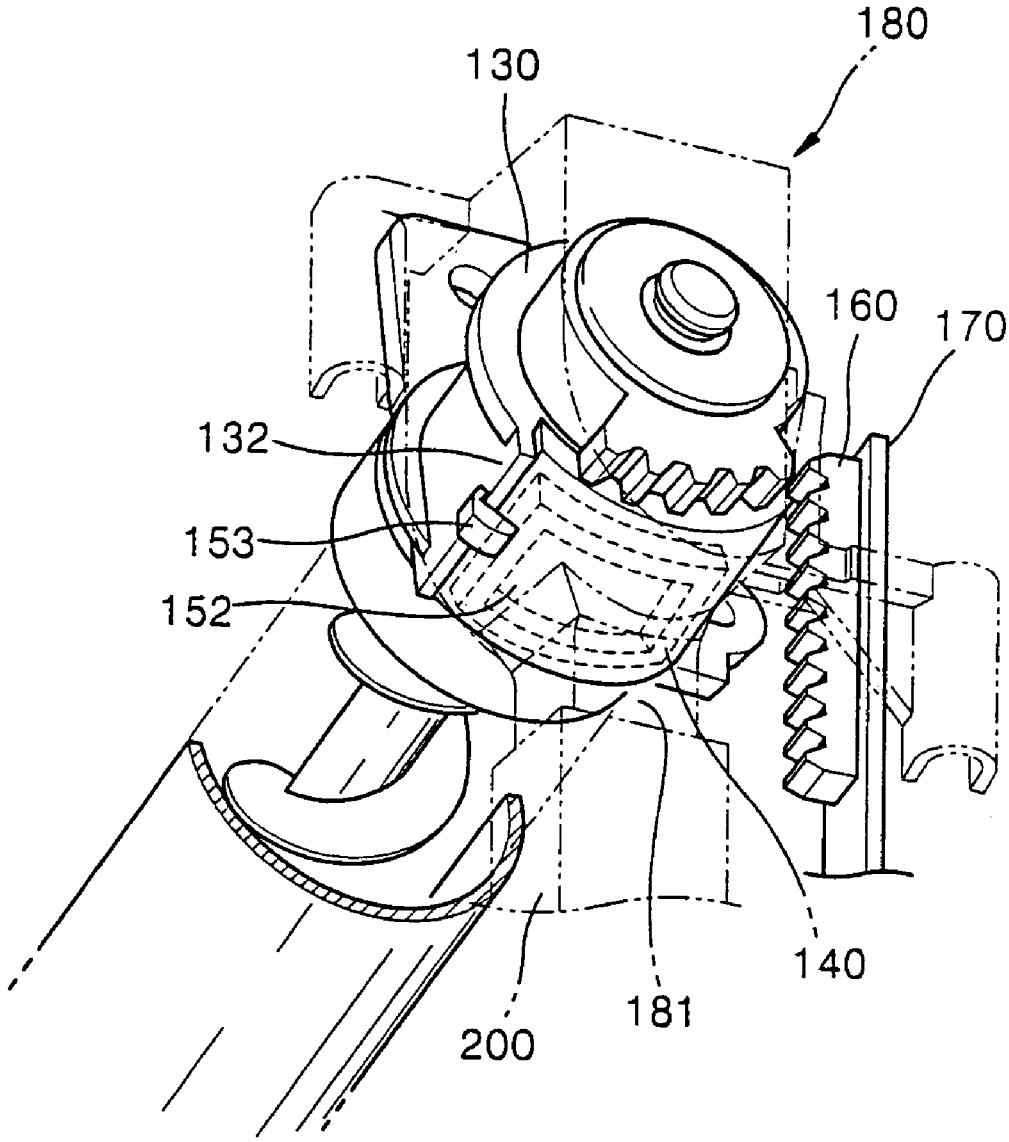

According to the above structure, when the waste toner temporarily held in the housing 110 is not transferred to the waste toner collection tank 200, that is, when the image holding body is removed from the printer, as shown in FIGS. 8A and 8B, the cover portion 152 of the shutter 150 closes the exhaust hole 131.

According to another embodiment of the invention where the image holding body is mounted to the printer, the exhaust guide member 130 descends towards the inlet guide member 180. When the exhaust hole 131 comes in contact with the inlet side of the inlet path 181, the inlet guide member 180 descends with the exhaust guide member 130. In this case, the compression spring 190 elastically supports the inlet guide member 180 so that the exhaust hole 131 and the inlet side of the inlet path 181 are closely adhered to each other. According to an embodiment where the sponge 140 is provided to the inlet side of the inlet path 181, a top surface of the sponge 140 contacts the cover portion 152 of the shutter 150 closing the exhaust hole 131. As such, the gap between the exhaust hole 131 and the inlet side of the inlet path 181 before the shutter 150 opens is prevented. Hereinafter, a case where the sponge 140 is provided to the inlet side of the inlet path 181 will be described.

Figure 9A:
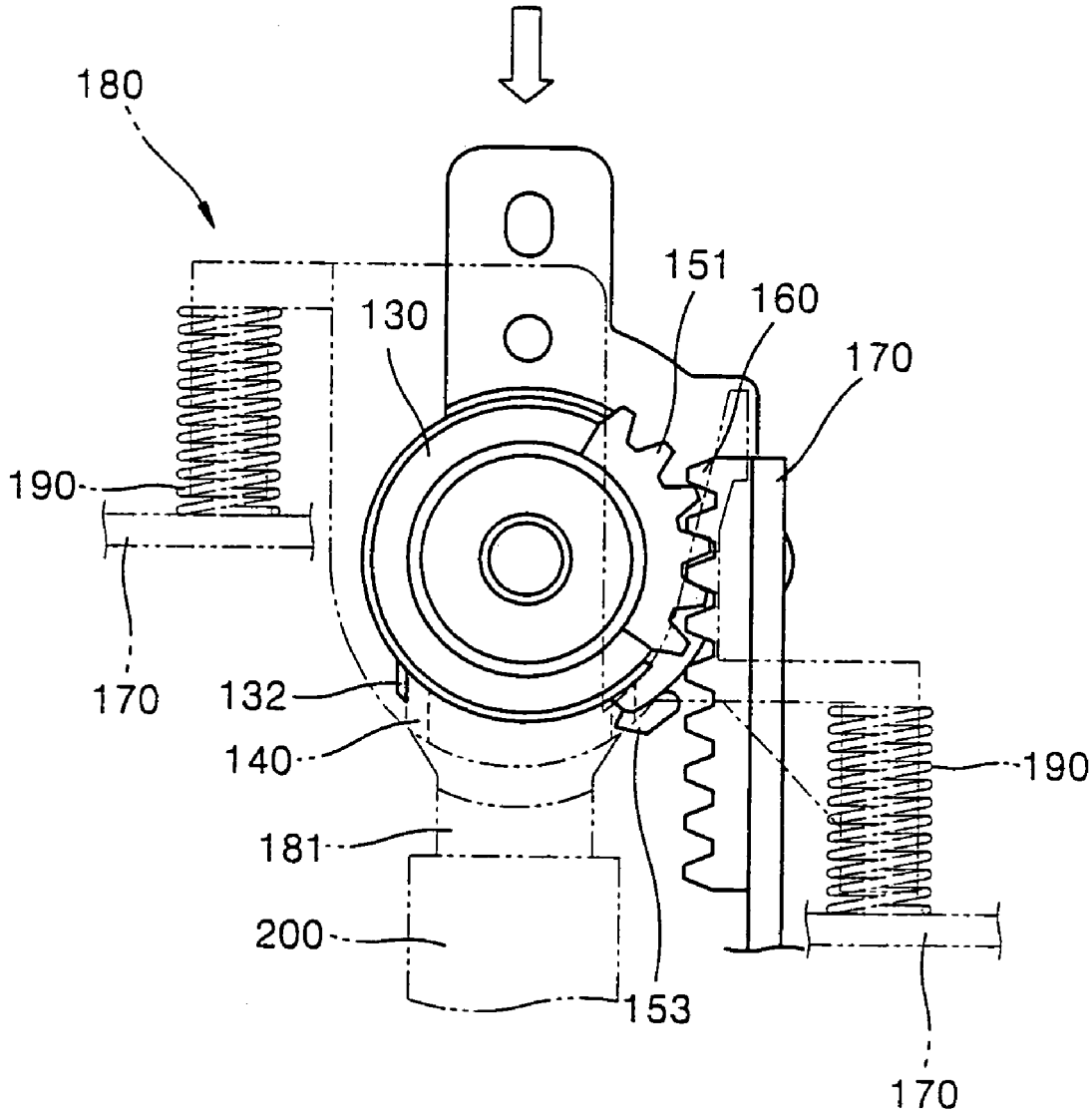
FIGS. 9A and 9B are a front view and a perspective view to show the open state of an exhaust hole of the waste toner collecting device.
Figure 9B:
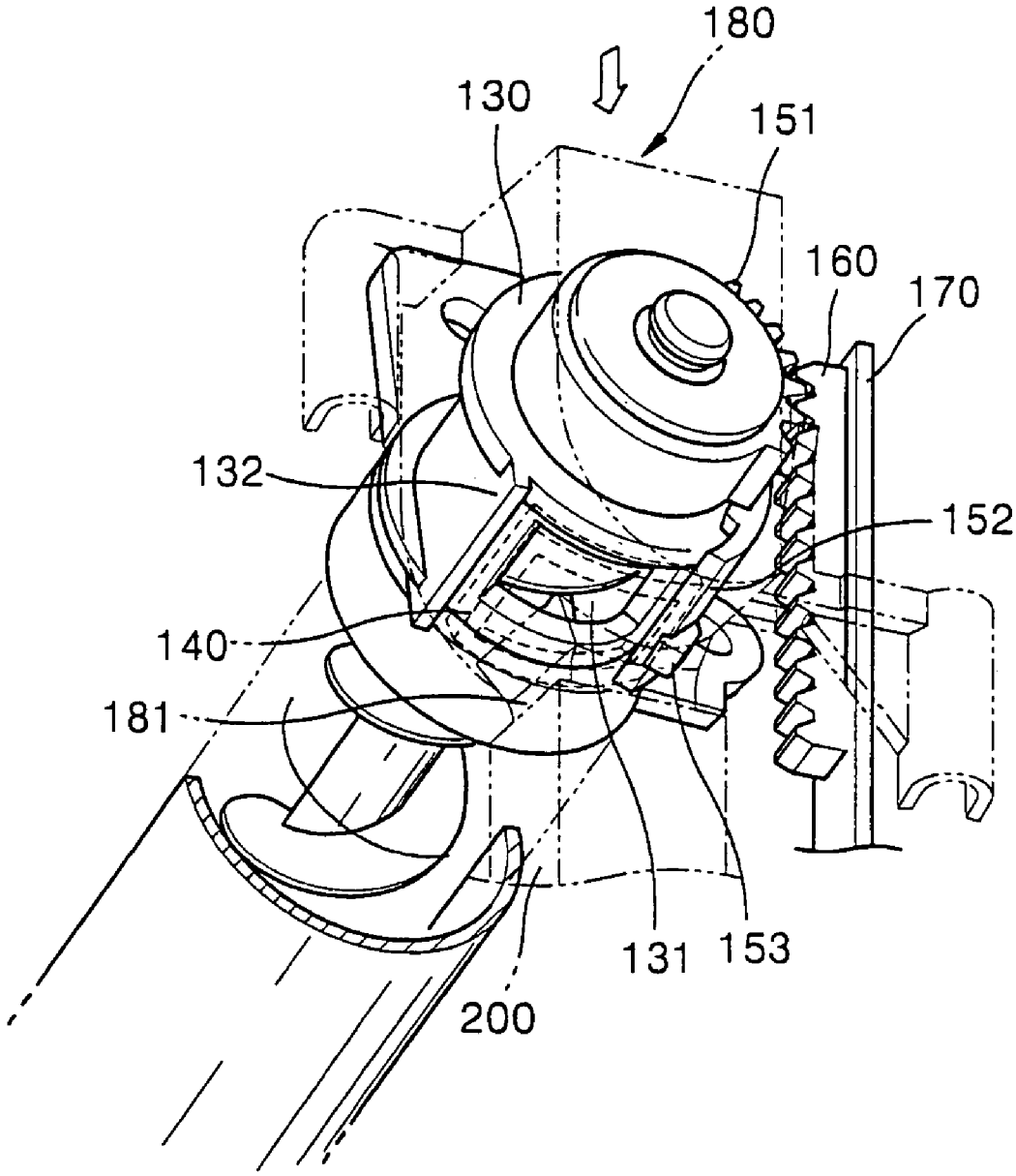

As the exhaust guide member 130 descends, the pinion 151 of the shutter 150 is engaged with the gear of the rack 160. The cover portion 152 of the shutter 150 is closely adhered to the sponge 140, thus, when the pinion 151 is rolled along the gear side of the rack 160 and the shutter 150 starts to open, the sponge 140 closes the gap between the exhaust hole 131 and the inlet side of the inlet path 181. In the case where the exhaust guide member 130 continues to descend, the shutter 150 opens the exhaust hole 131 completely, and the sponge 140 is compressed to close the gap between the exhaust hole 131 and the inlet side of the inlet path 181 while the inlet guide member 180 descends as shown in FIGS. 9A and 9B. Accordingly, the waste toner in the housing 110 transferred to the exhaust hole 131 by the auger 120 drops downward into the exhaust hole 131, and is transferred to the waste toner collection tank 200 via the inlet path 181 where a gap between the inlet side of the inlet path 181 and the exhaust hole 131 is closed by the sponge 140. Thus, the problem that occurs when the waste toner stacked around the exhaust hole 131 drops and/or splatters when the shutter 150 starts to open is stopped via the use of the sponge 140 as the compressible sealing member, and the waste toner is accurately transferred.

Alternatively, when the image holding body is removed from the printer, the exhaust guide member 130 ascends. As such, the inlet guide member 180 also ascends by the restoration force generated via the compression spring 190, and the gap between the exhaust hole 131 and the inlet path 181 remains closed by the sponge 140. According to this embodiment, the pinion 151 is rolled along the gear side of the rack 160, the shutter 150 is rotated in its original position, the locking protrusion 153 at a front end of the cover portion 152 is elastically inserted in the locking portion 132, and the exhaust hole 131 is finally closed. The top surface of the sponge 140 contacts the cover portion 152 of the shutter 150 closing the exhaust hole 131 so that there is no gap between the exhaust hole 131 and the inlet side of the inlet path 181 until the exhaust hole 131 is completely closed. To this end, the ascending position of the exhaust guide member 130 is adjusted so that the sponge 140 is spaced apart from the cover portion 152 of the shutter 150 from when the locking protrusion 153 is inserted in the locking portion 132.

Figure 10:
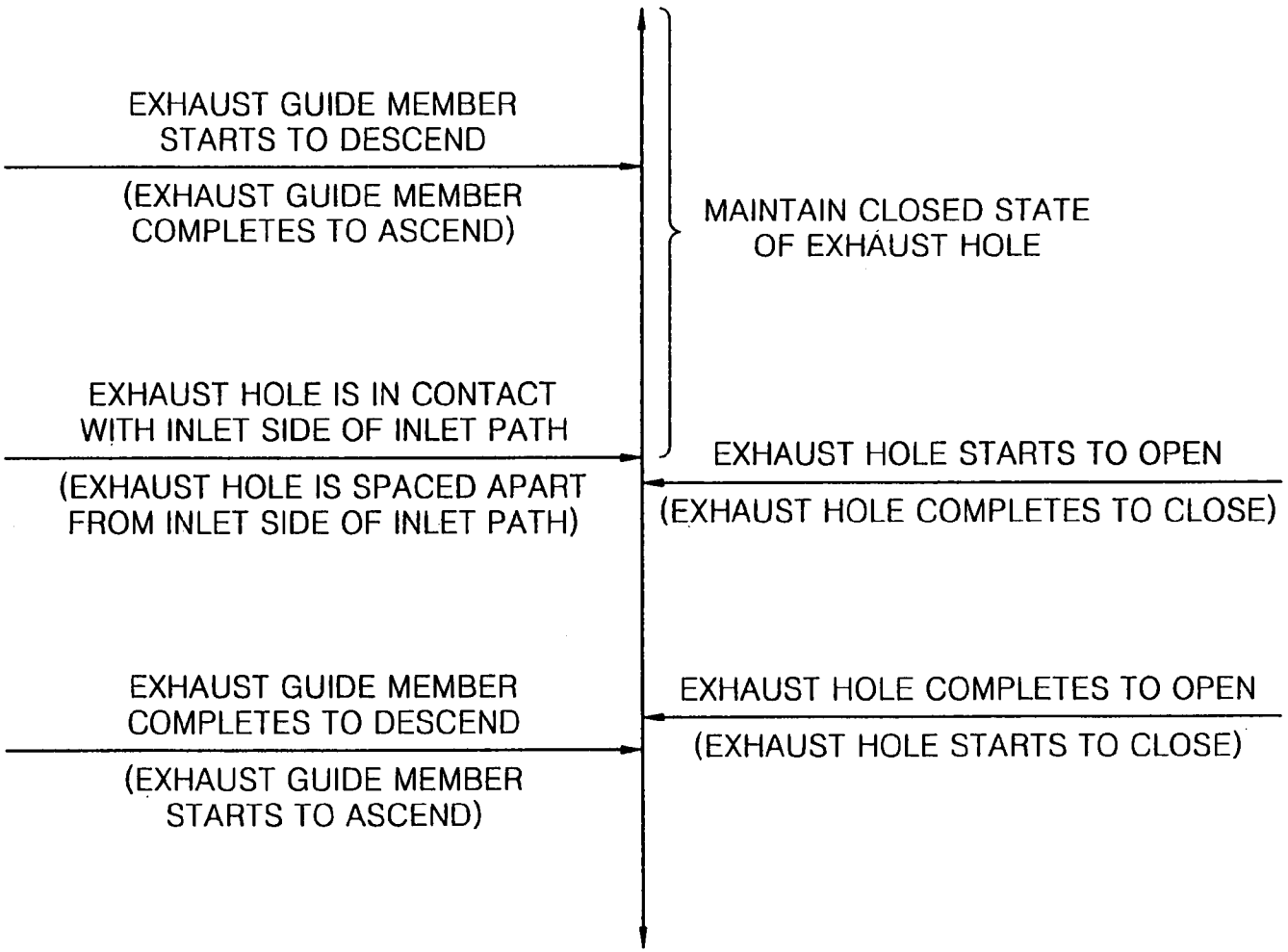
FIG. 10 is a timing chart to show the closed state of an exhaust hole according to ascending and descending operations of an exhaust guide member.

A method to collect waste toner using a waste toner collecting device will be described below with reference to FIG. 10. When an image holding body is mounted on a printer, the method comprises, closing the exhaust hole 131 via the shutter 150 so that waste toner does not leak when the exhaust guide member 130 starts to descend, maintaining the exhaust hole 131 in the closed state until the exhaust guide member 130 descends, and closely adhering the exhaust hole 131 to the inlet side of the inlet path 181 (when the sponge 140 is attached to the inlet side of the inlet path 181, the top surface of the sponge 140 is closely adhered to the cover portion 152 of the shutter 150). Further, according to the method, when the exhaust guide member 130 continues to descend, the compression spring 190 elastically supports the inlet guide member 180 and enables a gap between the exhaust hole 131 and the inlet side of the inlet path 181 not to be widened but to be closely maintained. And, when the exhaust hole 131 is closely adhered to the inlet side of the inlet path 181, the opening and closing unit operates. The method also comprises opening the exhaust hole 131 when the pinion 151 formed in the shutter 150 that is connected to the rack 160 rotates the shutter 150. The exhaust hole 131 is completely opened simultaneous with when the exhaust guide member 180 has completed descending or before descending of the exhaust guide member 180 is completed, and connection of the exhaust hole 131 and the inlet path 181 is completed. The waste toner is transferred from the waste toner collection tank 200 via the exhaust hole 131 and the inlet path 181.

Removing of the image holding body from the printer is performed in a reverse order. When the exhaust guide member 130 ascends, due to the operation of the pinion 151 and the rack 160, the shutter 150 is rotated in a direction opposite to the direction of rotation of the shutter 150 when the exhaust guide member 130 descends. Before the exhaust hole 131 is spaced from the inlet side of the inlet path 181, the shutter 150 completely closes the exhaust hole 131.

Accordingly, the exhaust hole 131 is maintained in a closed state when the exhaust hole 131 and the inlet side of the inlet path 181 are spaced from each other, and the exhaust hole 131 is opened after the exhaust hole 131 and the inlet side of the inlet path 181 are closely adhered to each other, thereby, preventing leakage of waste toner. Thus, when waste toner is transferred to a waste toner collection tank, the waste toner is prevented from splattering out onto peripheral devices and contaminating the peripheral devices.

Although a few embodiments of the present invention have been shown and described, it would be appreciated by those skilled in the art that changes may be made in this embodiment without departing front the principles and spirit of the invention, the scope of which is defined in the claims and their equivalents.

What is claimed is:

1. A waste toner collecting device of an electrophotographic printer, comprising:

a housing to temporarily hold waste toner removed from an image holding body;

an exhaust guide member including an exhaust hole through which the waste toner is exhausted;

an opening and closing unit to open and close the exhaust hole;

an inlet guide member comprising an inlet path to connect the exhaust hole to an inlet of a waste toner collection tank; and an elastic member to elastically support the inlet guide member so that a gap between the exhaust hole and an inlet side of the inlet path is respectively adjusted when the exhaust guide member ascends and descends.

2. The waste toner collecting device according to claim 1, wherein when the exhaust guide member descends, the opening and closing unit starts to open the exhaust hole in a state where the exhaust hole and the inlet side of the inlet path are closely adhered to each; and when the exhaust guide member ascends, the opening and closing unit completes a closing operation of the exhaust hole before the exhaust hole is spaced from the inlet side of the inlet path.

3. The waste toner collecting device according to claim 2, further comprising:

an elastic sealing member installed to the inlet side of the inlet path to elastically close a gap between the exhaust hole and the inlet side of the inlet path as the exhaust guide member ascends and descends.

4. The waste toner collecting device according to claim 2, wherein the opening and closing unit comprises:

a shutter rotatably installed to the exhaust guide member to open and close the exhaust hole;

a pinion formed on the shutter; and a rack engaged with the pinion to rotate the shutter when the exhaust guide member ascends and descends.

5. The waste toner collecting device according to claim 1, further comprising:

an auger to transfer the waste toner temporarily held in the housing to the exhaust hole of the exhaust guide member.

6. The waste toner collecting device according to claim 1, wherein the elastic member provided to support the inlet guide member is a compression spring.

7. The waste toner collecting device according to claim 1, further comprising:

an elastic sealing member to elastically close a gap between the exhaust hole and the inlet path.

8. The waste toner collecting device according to claim 7 wherein the elastic sealing member is attached to the inlet path.

9. An electrophotographic printer, comprising:

an image holding body to temporarily hold a toner image when an image is formed;

a waste toner collection tank to hold waste toner removed from the image holding body; and a waste toner collecting device to transfer the waste toner removed from the image holding body to the waste toner collection tank, wherein the waste toner collecting includes:

a housing to temporarily hold the waste toner;

an exhaust guide member to provide an exhaust hole through which the waste toner is exhausted;

an opening and closing unit which opens and closes the exhaust hole;

an inlet guide member having an inlet path to connect the exhaust hole to an inlet of the waste toner collection tank; and an elastic member to elastically support the inlet guide member so that a gap between the exhaust hole and an inlet side of the inlet path is respectively adjusted when the exhaust guide member ascends and descends.

10. The electrophotographic printer according to claim 9, wherein when the exhaust guide member descends, the opening and closing unit starts to open the exhaust hole in a state where the exhaust hole and the inlet side of the inlet path are closely adhered to each; and when the exhaust guide member ascends, the opening and closing unit completes a closing operation of the exhaust hole before the exhaust hole is spaced from the inlet side of the inlet path.

11. The electrophotographic printer according to claim 10, wherein the waste toner collecting device further comprises an elastic sealing member installed on the inlet side of the inlet path to elastically close a gap between the exhaust hole and the inlet side of the inlet path as the exhaust guide member ascends and descends.

12. The electrophotographic printer according to claim 10, wherein the opening and closing unit comprises:

a shutter rotatably installed to the exhaust guide member to open and close the exhaust hole and in which a pinion is formed; and a rack engaged with the pinion to rotate the shutter when the exhaust guide member ascends and descends.

13. The electrophotographic printer according to claim 9, wherein the waste toner collecting device further comprises:

an auger to transfer the waste toner temporarily held in the housing to the exhaust hole of the exhaust guide member.

14. The electrophotographic printer according to claim 9, wherein the elastic member provided to support the inlet guide member is a compression spring.

15. The electrophotographic printer according to claim 9, wherein the waste toner collecting device further comprises an elastic sealing member to elastically close a gap between the exhaust hole and the inlet path.

16. The electrophotographic printer according to claim 15, wherein the elastic sealing member is attached to the inlet path.

17. A method of collecting waste toner of an electrophotographic printer having an exhaust guide member including an exhaust hole, an inlet guide member including an inlet path, and an opening and closing unit, the method comprising:

descending the exhaust guide member when the exhaust hole is closed;

closely adhering exhaust hole and an inlet side of the inlet path to each other opening the exhaust hole via the opening and closing unit, and closing the exhaust hole via the opening and closing unit before the exhaust hole is spaced from the inlet side of the inlet path.

18. A waste toner collecting device of an electrophotographic image forming apparatus, comprising:

a housing to hold waste toner removed from an image holding body;

an exhaust guide member provided to an end portion of the housing;

an exhaust hole provided on the exhaust guide member through which the waste toner is exhausted;

an opening and closing unit to open and close the exhaust hole;

a waste toner collection tank to receive the waste toner;

an inlet guide member to connect the exhaust hole to the waste toner collection tank; and an elastic member to elastically adjust a space between the inlet guide member and the exhaust hole when the exhaust guide ascends and descends.

* * * * *

UNITED STATES PATENT AND TRADEMARK OFFICE

CERTIFICATE OF CORRECTION

PATENT NO. : 7,020,428 B2
APPLICATION NO. : 10/734608
DATED : March 28, 2006
INVENTOR(S) : Moon-Bae Park et al.

It is certified that error appears in the above-identified patent and that said Letters Patent is hereby corrected as shown below:

Column 7, line 67, change “each;” to --each other;--

Column 8, line 60, change “each;” to --each other;--

Column 10, line 4, after “other” insert --;--

Signed and Sealed this

Fifteenth Day of August, 2006

JON W. DUDAS
*Director of the United States Patent and Trademark Office*